US005221375A

United States Patent [19]

Nagahora et al.

[11] Patent Number: 5,221,375

[45] Date of Patent: Jun. 22, 1993

[54] CORROSION RESISTANT ALUMINUM-BASED ALLOY

[75] Inventors: Junichi Nagahora, Yokohama; Kazuo Aikawa, Namerikawa; Katsumasa Ohtera, Yamato; Hideki Takeda, Kawasaki; Keiko Yamagata, Tateyama, all of Japan

[73] Assignee: Yoshida Kogyo K.K., Tokyo, Japan

[21] Appl. No.: 660,450

[22] Filed: Feb. 22, 1991

[30] Foreign Application Priority Data

Mar. 22, 1990 [JP] Japan ..... 2-69663

[51] Int. Cl.[5] ..... C22C 45/08

[52] U.S. Cl. ..... 148/403; 420/551; 420/552

[58] Field of Search ..... 420/538, 550, 551, 552; 148/403

[56] References Cited

U.S. PATENT DOCUMENTS 4,595,429 6/1986 LeCaer et al. ..... 148/403
4,710,246 12/1987 LeCaer et al. ..... 148/403
4,891,068 1/1990 Masumoto et al. ..... 148/403
5,053,084 10/1991 Masumoto et al. ..... 148/403
5,122,205 6/1992 Masumoto et al. ..... 420/551

*Primary Examiner*—George Wyszomierski
*Attorney, Agent, or Firm*—Flynn, Thiel, Boutell & Tanis

[57] ABSTRACT

Disclosed is a corrosion resistant aluminum-based alloy which is composed of a compound having a composition consisting of the general formula: $Al_aM_bMo_cX_dCr_e$ wherein: M is one or more metal elements selected from the group consisting of Ni, Fe, Co, Ti, V, Mn, Cu and Ta; X is Zr or a combination of Zr and Hf; and a, b, c, d and e are, in atomic percentages; $50\% \leqq a \leqq 89\%$, $1\% \leqq b \leqq 25\%$, $2\% \leqq c \leqq 15\%$, $4\% \leqq d \leqq 20\%$ and $4\% \leqq e \leqq 20\%$, the compound being at least 50% by volume composed of an amorphous phase. The Al-based alloy exhibits a very high corrosion resistance in severe corrosive environments, such as hydrochloric acid solution or sodium hydroxide solution, due to the formation of a highly passivative protective film. Therefore, the alloy exhibits a good durability in long services under such severe corrosive environments.

11 Claims, 4 Drawing Sheets

CORROSION RESISTANT ALUMINUM-BASED ALLOY

BACKGROUND OF THE INVENTION

1. Field of the Invention

The present invention relates to aluminum-based alloys having a superior corrosion resistance together with a high degree of hardness, heat-resistance and wear-resistance, and which are useful in various industrial applications.

2. Description of the Prior Art

As conventional aluminum-based alloys, there are known pure aluminum type and multicomponent system alloys, such as Al-Mg system, Al-Cu system, Al-Mn system, or the like, and these known aluminum-based alloy materials have been used extensively in a variety of applications, for example, as structural component materials for aircraft, cars, ships or the like; outer building materials, sashes, roofs, etc.; structural component materials for marine apparatuses and nuclear reactors, etc., according to their properties.

However, these conventional alloy materials have difficulties in long services in corrosive environments.

Therefore, the present applicant has developed a corrosion-resistant material consisting of an amorphous aluminum alloy Al-M-Mo-Hf-Cr containing at least 50% by volume of an amorphous phase, wherein M is one or more metal elements selected from Ni, Fe and Co. (refer to Japanese Patent Application No. 2-51 823).

However, there are difficulties in the preparation of the above amorphous alloys. That is, when the alloy is made amorphous, the amounts of Cr, which has the effect of improving the corrosion resistance, tend to be restricted depending on the amounts of Hf, which improves the above ability to form an amorphous phase. When Cr is added in amounts exceeding a certain amount of Hf, crystallization tends to occur in part and thereby the corrosion resistance of the thus partially crystallized alloy will become low as compared with that of entirely amorphous alloys. As a further problem, when Hf is added in large amounts, the resulting alloys become expensive, because Hf is the most expensive element among the above-mentioned elements.

SUMMARY OF THE INVENTION

In order to eliminate the above-mentioned problems, the present invention is directed to the provision of a corrosion-resistant aluminum-based alloy at a relatively low cost in which a further improved corrosion-resistance can be achieved by wholly or partially replacing Hf with Zr.

According to the present invention, there is provided a corrosion resistant aluminum-based alloy which is composed of a compound having a composition consisting of the general formula:

$$Al_aM_bMo_cX_dCr_e$$

wherein:

M is one or more metal elements selected from the group consisting of Ni, Fe, Co, Ti, V, Mn, Cu and Ta;

X is Zr or a combination of Zr and Hf; and a, b, c, d and e are, in atomic percentages;

$50\% \leq a \leq 89\%$, $1\% \leq b \leq 25\%$, $2\% \leq c \leq 15\%$, $4\% \leq d \leq 20\%$ and $4\% \leq e \leq 20\%$, the compound being at least 50% by volume composed of an amorphous phase.

As described above, since the Al-based alloys of the present invention have at least 50% by volume of an amorphous phase, they have an advantageous combination of properties of high hardness, high heat-resistance and high wear-resistance which are all characteristic of amorphous alloys. Further, the alloys are durable for a long period of time in severe corrosive environments, such as hydrochloric acid solution containing chlorine ions or sodium hydroxide solution containing hydroxyl ions due to the formation of spontaneously passavative stable protective films and exhibit a very high corrosion-resistance. The aluminum-based alloys can be provided at a relatively low cost.

DETAILED DESCRIPTION OF THE PREFERRED EMBODIMENTS

Figure 1:
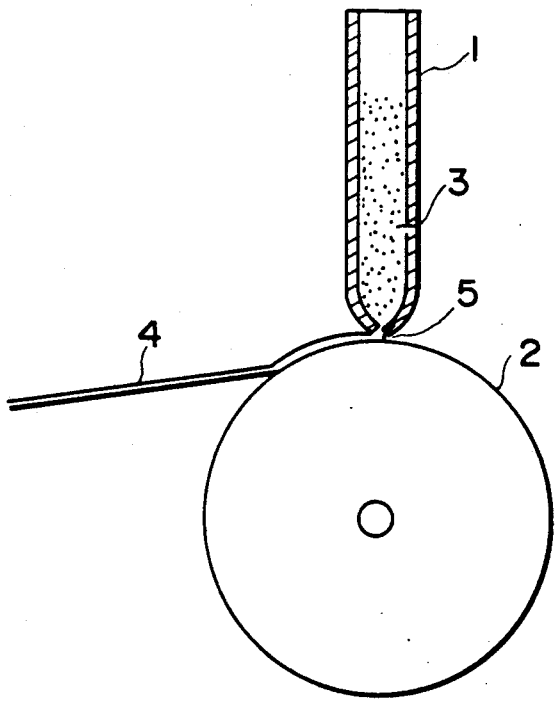
FIG. 1 is an illustration showing a device suitable for the production process according to the present invention.

Generally, an alloy has a crystalline structure in the solid state. However, in the preparation of an alloy with a certain composition, an amorphous structure, which is similar to a liquid but does not have a crystalline structure, is formed by preventing the formation of long-range order structure during solidification through, for example, rapid solidification from the liquid state. The thus formed alloy having such a structure is called an "amorphous alloy". Amorphous alloys are generally composed of a homogeneous single phase of supersaturated solid solution and have a significantly higher strength as compared with ordinary practical metallic materials. Further, amorphous alloys may exhibit a very high corrosion resistance and other superior properties depending on their compositions.

The aluminum-based alloys of the present invention can be produced by rapidly solidifying a melt of an alloy having the composition as specified above employing liquid quenching methods. Liquid quenching methods are known as methods for the rapid solidification of an alloy melt and, for example, a single roller melt-spinning method, twin-roller melt-spinning method and in-rotating-water melt-spinning method are especially effective. In these methods, a cooling rate of about $10^4$ to $10^7$ K/sec can be obtained. In order to produce thin ribbon materials by the single-roller melt-spinning method, twin-roller melt-spinning method or the like, the molten alloy is example, copper or steel, with a diameter of about 30 -300 mm which is rotating at a constant rate of about 300 -10000 rpm. In these methods, various thin ribbon materials with a width of about 1 -300 mm and a thickness of about 5 -500 μm can be readily obtained. Alternatively, in order to produce wire materials by the in-rotating-water melt-spinning method, a jet of the molten alloy is directed, under application of a back pressure of argon gas, through a nozzle into a liquid refrigerant layer with a depth of about 1 to 10 cm which is held by centrifugal force in a drum rotating at a rate of about 50 to 500 rpm. In such a manner, fine wire materials can be readily obtained. In this technique, the angle between the molten alloy ejected from the nozzle and the liquid refrigerant surface is preferably in the range of about 60° to 90° and the relative velocity ratio of the ejected molten alloy to the liquid refrigerant surface is preferably in the range of about 0.7 to 0.9.

Further, the aluminum-based alloys of the present invention may be also obtained by depositing a source material having a composition consisting of the above general formula onto a substrate surface by thin film formation techniques, such as sputtering, vacuum deposition, ion plating, etc. and thereby forming a thin film having the above composition.

As the sputtering deposition process, there may be mentioned a diode sputtering process, triode sputtering process, tetrode sputtering process, magnetron sputtering process, opposing target sputtering process, ion beam sputtering process, dual ion beam sputtering process, etc, and, in the former five processes, there are the direct current application type and the high-frequency application type.

The sputtering deposition process will be more specifically described hereinafter. In the sputtering deposition process, a target having the same composition as that of the thin film to be formed is bombarded by ion sources produced in the ion gun or the plasma, etc., so that neutral particles or ion particles in the state of atoms, molecules or clusters are produced from the target upon the bombardment. The neutral or ion particles produced in a such manner are deposited onto the substrate and the thin film as defined above is formed.

Particularly, ion beam sputtering, plasma sputtering, etc., are effective and these sputtering processes provide a cooling rate of the order of $10^5$ to $10^7$ K/sec. Due to such a cooling rate, it is possible to produce an alloy thin film of which at least 50 volume % is composed of an amorphous phase. The thickness of the thin film can be adjusted by the sputtering time and, usually, the thin film formation rate is on the order of 2 to 7 μm per hour.

A further embodiment of the present invention in which magnetron plasma sputtering is employed is specifically described. In a sputtering chamber in which a sputtering gas is held at a low pressure ranging from $1 \times 10^{-3}$ to $10 \times 10^{-3}$ mbar, an electrode (anode) and a target (cathode) composed of the composition defined above are disposed opposite to one another with a spacing of 40 to 80 mm and a voltage of 200 to 500 V is applied to produce plasma between the electrodes. A substrate on which the thin film is to be deposited is disposed in this plasma forming area or in the vicinity of the area and the thin film is formed thereon.

Besides the above processes, the alloy of the present invention can be also obtained as rapidly solidified powder by various atomizing processes, for example, high pressure gas atomizing process, or spray process.

Whether the rapidly solidified aluminum-based alloys thus obtained are amorphous or not can be known by an ordinary X-ray diffraction method by checking whether or not there are halo patterns characteristic of an amorphous structure.

In the aluminum-based alloys of the present invention having the general formula as defined above, the reason why a, b, c, d and e are limited by atomic percentages as set forth above is that when they fall outside the respective ranges, amorphization becomes the formation of an amorphous alloy difficult or the resulting alloys become brittle. Consequently, a compound having at least 50% by volume of an amorphous phase can not be obtained by industrial processes such as sputtering deposition.

M element is at least one metal element selected from the group consisting of Ni, Fe, Co, Ti, V, Mn, Cu and Ta and these M elements and Mo have an effect of improving the alloys ability to form an amorphous phase and, at the same time, improve the alloys hardness, strength and heat resistance.

X element is Zr or a combination of Zr and Hf and is effective particularly in improving the ability to form an amorphous phase in the above alloys. Among the X elements, Zr forms a passivative thin film of $ZrO_x$ which hardly corrodes and, thereby, improves the corrosion resistance of the foregoing alloy. Further, since Zr provides a greatly improved amorphous-phase forming ability as compared with Hf, it makes possible the formation of an amorphous alloy even when Cr, which provides a great improvement in corrosion resistance but reduces the amorphous-phase forming ability, is added in a large amount. Further, Zr is cheaper than Hf and makes possible the provision of the alloys of the present invention at a relatively low cost.

There is a preferable compositional relationship between Zr and Cr. When the ratio of Cr to Zr is about from 0.8:1 to 1.8:1, an amorphous single phase alloy free of a crystalline phase can be obtained because of the alloys tendency to form an amorphous phase. However, since the range of the Cr : Zr ratio may be varied depending on the addition amounts of the M elements and Mo, the range is not always restricted to the above specified range.

Cr, as an important effect, greatly improves the corrosion resistance of the inventive alloy because Cr forms a passivative film in cooperation with the M elements and Mo when it is coexistent with them in the alloy. Another reason why the atomic percentage (e) of Cr is limited to the aforesaid range is that amounts of Cr of less than 4 atomic % can not improve sufficiently the corrosion resistance contemplated by the present invention, while amounts exceeding 20 atomic % make the resultant alloy excessively brittle and impractical for industrial applications.

Further, when the aluminum-based alloy of the present invention is prepared as a thin film, it has a high degree of toughness depending upon its composition. Therefore, such a tough alloy can be bond-bent to 180° without cracking or peeling from a substrate.

Now, the present invention will described with reference to the following examples.

EXAMPLE 1

A molten alloy 3 having each of the compositions as shown in Table 1 was prepared using a high-frequency melting furnace and was charged into a quartz tube 1 having a small nozzle 5 (0.5 mm in bore diameter) at the tip thereof, as shown in FIG. 1. After heating to melt the alloy 3, the quartz tube 1 was disposed right above a copper roll 2. Then, the molten alloy 3 contained in the quartz-tube 1 was ejected from the small nozzle 5 of the quartz tube 1 under the application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

Alloy thin ribbons prepared under the processing conditions as described above were each subjected to X-ray diffraction analysis. It was confirmed that an amorphous phase has formed in the resulting alloys.

The composition of each rapidly solidified thin ribbon was determined by quantitative analysis using an X-ray microanalyzer.

Test specimens having a predetermined length were cut from the aluminum-based alloy thin ribbons of the present invention and immersed in a 1N-HCl aqueous solution at 30° C. to test their corrosion resistance to HCl. Further test specimens having a predetermined length were cut from the aluminum-based alloy thin ribbons and immersed in a 1N-NaOH aqueous solution at 30° C. to test their corrosion resistance to sodium hydroxide. The test results are given in Table 1. In the table, corrosion resistance was evaluated in terms of corrosion rate.

TABLE 1

Corrosion rates measured in an aqueous 1N—HCl solution and an aqueous 1N—NaOH solution at 30° C.

| Alloy (at. %) | 1N—HCl 30° C. corrosion rate (mm/year) | 1N—NaOH 30° C. corrosion rate (mm/year) | Structure* |
|---|---|---|---|
| $Al_{59}Ni_{10}Mo_9Zr_9Cr_{13}$ | $9.7 \times 10^{-3}$ | 0 | Amo |
| $Al_{59}Ni_9Mo_9Zr_{14}Cr_9$ | $1.7 \times 10^{-2}$ | 0 | Amo |
| $Al_{69}Ni_6Mo_7Zr_9Cr_9$ | $6.0 \times 10^{-2}$ | $3.0 \times 10^{-3}$ | Amo |
| $Al_{78}Ta_2Mo_5Zr_8Cr_7$ | $2.5 \times 10^{-1}$ | $8.0 \times 10^{-2}$ | Amo |
| $Al_{72}Co_6Mo_5Zr_{10}Cr_7$ | $1.5 \times 10^{-3}$ | $1.2 \times 10^{-2}$ | Amo + Cry |
| $Al_{67}Fe_8Mo_7Zr_{10}Cr_8$ | $7.5 \times 10^{-2}$ | $1.8 \times 10^{-2}$ | Amo |
| $Al_{78}V_2Mo_5Zr_8Cr_7$ | $2.5 \times 10^{-1}$ | $8.0 \times 10^{-2}$ | Amo + Cry |
| $Al_{75}Cu_5Mo_5Zr_8Cr_7$ | $2.1 \times 10^{-1}$ | $9.2 \times 10^{-2}$ | Amo |
| $Al_{59}Ni_9Mo_9Zr_5Hf_4Cr_{14}$ | $1.5 \times 10^{-3}$ | $5.0 \times 10^{-3}$ | Amo |

Remark:
Amo: Amorphous structure
Cry: Crystalline structure

It is clear from Table 1 that the aluminum-based alloys of the present invention have a superior corrosion resistance in an aqueous hydrochloric acid solution and an aqueous sodium hydroxide solution.

In a comparison between the inventive aluminum-based alloys and prior art aluminum-based alloys proposed in Japanese Pat. Application No. 2 - 51 823, specimens having a predetermined length were cut from thin ribbons of the respective aluminum-based alloys and immersed in a 1N-HCl aqueous solution at 30° C. to conduct comparative tests on corrosion resistance to hydrochloric acid. Alternatively, specimens having a predetermined length were cut from the respective aluminum-based alloy thin ribbons and immersed in a 1N-NaOH aqueous solution at 30° C. to conduct comparative tests on corrosion resistance to sodium hydroxide. The results of these tests are shown in table 2. Evaluation of corrosion resistance as shown in the table was made in terms of corrosion rate.

TABLE 2

Corrosion rates measured in an aqueous 1N—HCl solution and an aqueous 1N—NaOH solution at 30° C.

| | Alloy (at. %) | 1N—HCl 30° C. corrosion rate (mm/year) | 1N—NaOH 30° C. corrosion rate (mm/year) |
|---|---|---|---|
| Comparative test 1 | $Al_{68}Ni_9Mo_7Hf_7Cr_9$ | $2.2 \times 10^{-1}$ | $2.4 \times 10^{-2}$ |
| | $Al_{68}Ni_9Mo_7Zr_7Cr_9$ | $4.6 \times 10^{-2}$ | $2.0 \times 10^{-2}$ |
| Comparative test 1 | $Al_{75}Ni_7Mo_3Hf_8Cr_7$ | $2.4 \times 10^{-1}$ | $7.1 \times 10^{-2}$ |
| | $Al_{75}Ni_7Mo_3Zr_8Cr_7$ | $1.9 \times 10^{-1}$ | $5.7 \times 10^{-2}$ |
| Comparative test 1 | $Al_{70}Fe_9Mo_5Hf_9Cr_7$ | $2.3 \times 10^{-1}$ | $2.7 \times 10^{-1}$ |
| | $Al_{70}Fe_9Mo_5Zr_9Cr_7$ | $1.8 \times 10^{-1}$ | $2.1 \times 10^{-1}$ |

Table 2 reveals that, in all comparative tests, the alloys of the present invention with Zr substituted for Hf exhibit a superior corrosion-resistance to both the aqueous hydrochloric acid solution and the aqueous sodium hydroxide solution.

Figure 2:
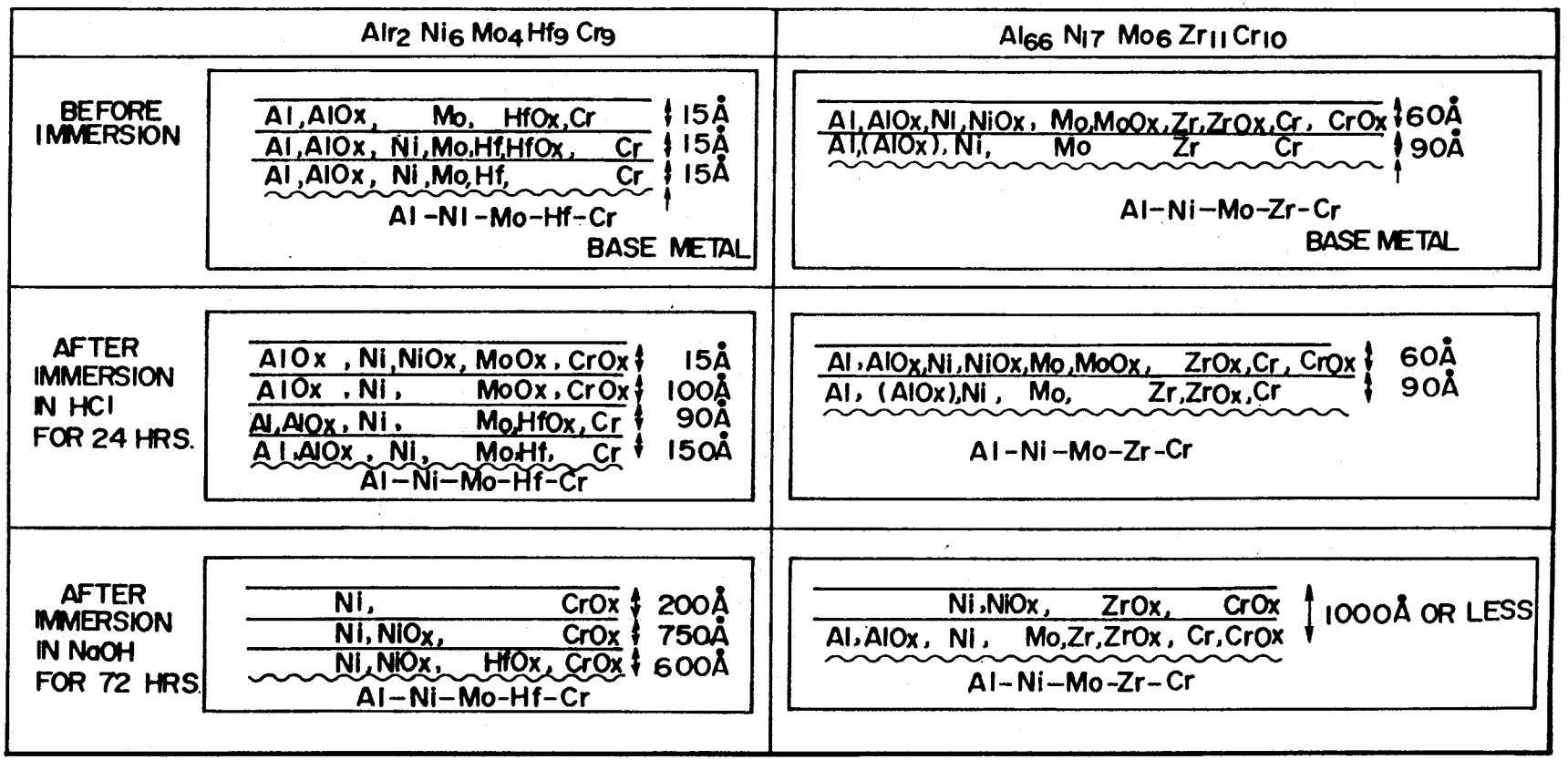
FIG. 2 shows immersion corrosion test results.

Further, a thin ribbon of $Al_{66}Ni_7Mo_6ZR_{11}Cr_{10}$ of the present invention and $Al_{72}Ni_6Mo_4Hf_9Cr_9$ disclosed in Japanese Patent Application No. 2 - 51 823 were immersed in an aqueous 1N-HCl solution at 30° C. for 24 hours. Another set of the same alloys were immersed in an aqueous 1N-NaOH solution 30° C. for 72 hours. The thus immersed alloy thin ribbon samples were examined for their surface film state through ESCA. FIG. 2 shows the results. It is clear from FIG. 2 that elusion of Hf and $HfO_x$ occurs in the alloy of the Japanese Patent Application No. 2 - 51 823 after immersion in HCl and NaOH, but $ZrO_x$ of the alloy of the present invention forms a highly passivative film in combination with Cr oxide or Ni oxide without being subjected to corrosion.

Figure 3:
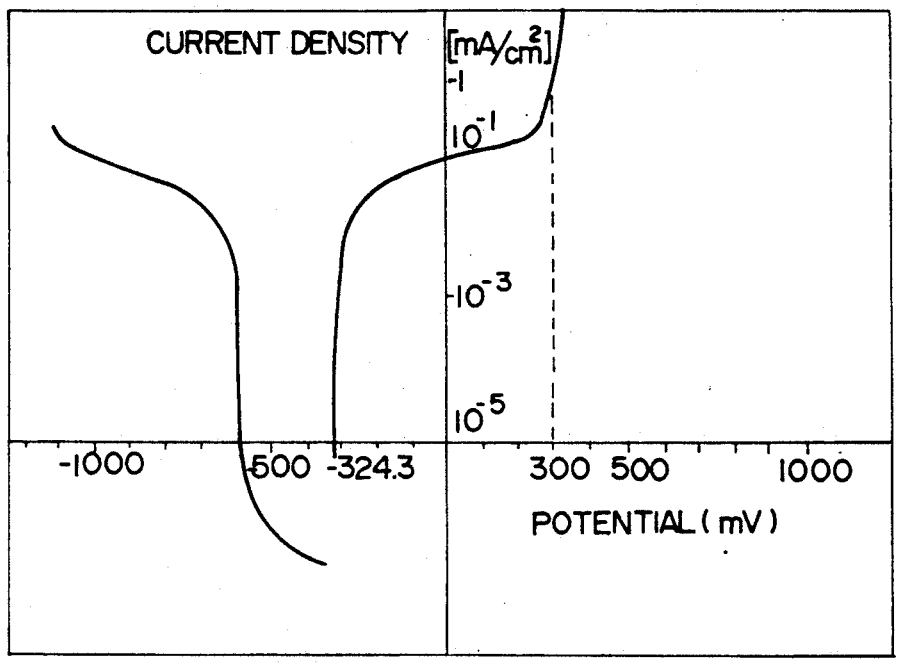
FIGS. 3 and 4 are graphs showing corrosion-resistance test results for alloys of the present invention.
Figure 4:
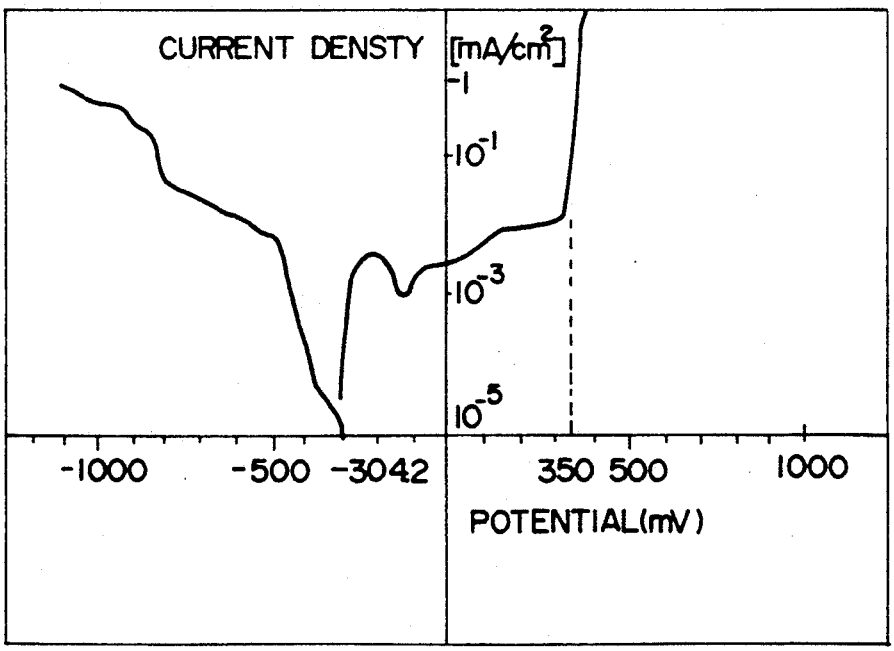

Pitting potential measurements were made for an $Al_{59}Ni_9Mo_9Zr_{10}Cr_{13}$ thin ribbon and an $Al_{59}Ni_9Mo_9Zr_9Cr_{14}$ thin ribbon, both alloys being within the scope of the present invention in a 30 g/1-NaCl aqueous solution at 30° C. and the measurement results were given in Table 3. Further, polarization curves are measured in the 30 g/1-NaCl aqueous solution to examine the corrosion resistance of the two samples. The results are shown in FIGS. 3 and 4.

Table 3 shows that the Al-based alloys of the present invention are spontaneously passive also in the aqueous solution containing 30 g/1 of NaCl at 30° C. and form highly passive films. The Al-based alloys show very high pitting potential levels in the aqueous sodium chloride solution without forming higher passivative films by immersion in an aqueous hydrochloric acid solution or an aqueous sodium hydroxide solution. For example, $Al_{59}Ni_9Mo_9Zr_{10}Cr_{13}$ and $Al_{59}Ni_9Mo_9Zr_9CR_{14}$ showed very high pitting potentials of 300 mV and 350 mV, respectively. It is clear from the above test results that the aluminum-based alloys of the present invention have a considerably higher corrosion-resistance.

TABLE 3

Pitting potentials measured in an aqueous 30 g/l NaCl solution

| Alloy (at. %) | Pitting potential mV(SCE) |
|---|---|
| $Al_{59}Ni_9Mo_9Zr_{10}Cr_{13}$ | +300 |
| $Al_{59}Ni_9Mo_9Zr_9Cr_{14}$ | +350 |

Figure 5:
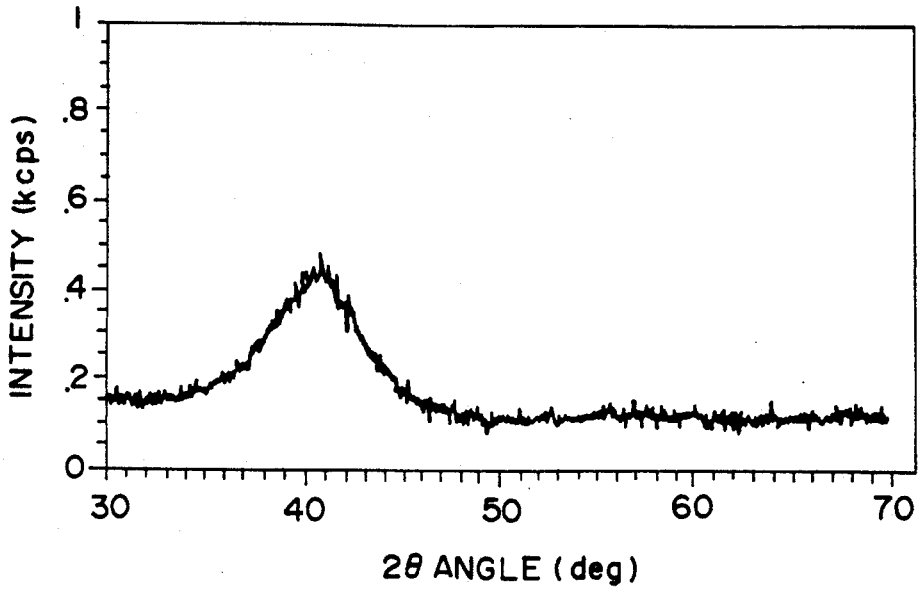
FIGS. 5 and 6 are diagrams showing the results of X-ray diffraction of the Examples.
Figure 6:
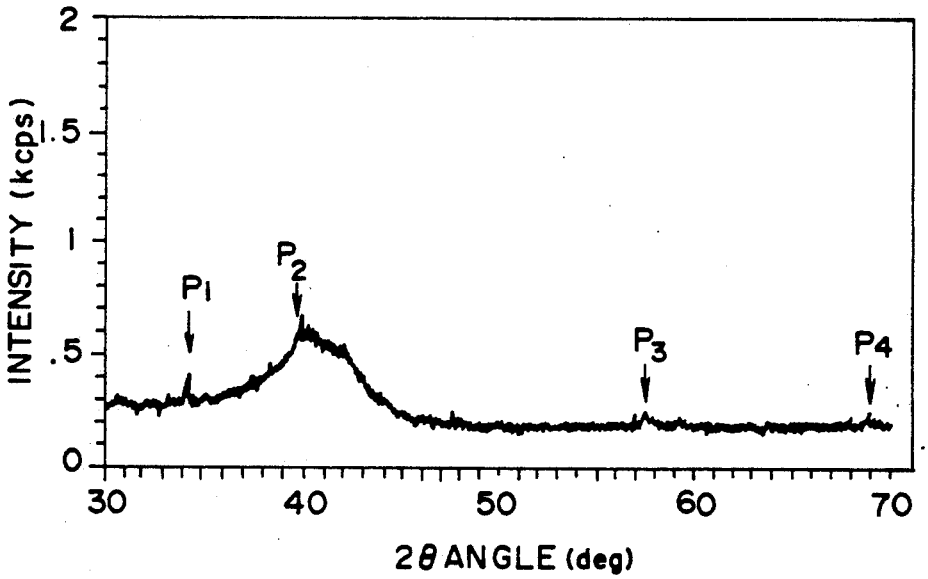

X-ray diffraction measurements were made for $Al_{69.5}Ni_{6.7}Mo_{7.0}Zr_{8.7}Cr_{8.7}$ of the present invention and $Al_{69.5}Ni_{6.1}Mo_{7.0}Hf_{8.7}Cr_{8.7}$. In the latter alloy, Zr of the former alloy is substituted by Hf. The results are shown in FIGS. 5 and 6. As shown in FIG. 5, halo patterns characteristic of an amorphous structure is confirmed in the alloy $Al_{69.5}Ni_{6.1}Mo_{7.0}Zr_{8.7}Cr_{8.7}$ of the present invention and it is clear that the alloy is composed of a single-phase amorphous alloy. On the other hand, in FIG. 6, $Al_{69.5}Ni_{6.1}Mo_{7.0}Hf_{8.7}Cr_{8.7}$ showed peaks P1 to P4 which indicate the presence of a small amount of a crystalline phase and it can be seen that the alloy is composed of a mixed-phase structure of a crystalline phase containing a small amount of a crystalline phase. Further, the above two alloys were immersed in an aqueous 1N-HCl solution at 30° C. to examine their corrosion resistance to hydrochloric acid.

Alternatively, the same two alloys were immersed in an aqueous 1N-NaOH solution at 30° C. to examine their corrosion resistance to sodium hydroxide. The results are shown in Table 4.

TABLE 4

| Alloy (at. %) | 1N—HCl 30° C. corrosion rate (mm/year) | 1N—NaOH 30° C. corrosion rate (mm/year) |
|---|---|---|
| $Al_{69.5}Ni_{6.1}Mo_{7.0}Zr_{8.7}Cr_{8.7}$ | $6.0 \times 10^{-2}$ | $3.0 \times 10^{-3}$ |
| $Al_{69.5}Ni_{6.1}Mo_{7.0}Hf_{8.7}Cr_{8.7}$ | $8.0 \times 10^{-2}$ | $4.5 \times 10^{-3}$ |

It can be seen from Table 4 that the single-phase amorphous alloy with Zr substituted for Hf according to the present invention has a superior corrosion resistance to both aqueous solutions of hydrochloric acid and sodium hydroxide.

EXAMPLE 2

The amorphous alloys of the present invention prepared by the production procedure set forth in Example 1 were ground or crushed to a powder. When the thus obtained powder is used as pigment for a metallic paint, there can be obtained a highly durable metallic paint which exhibits a high resistance to corrosion attack over a long period.

What is claimed is:

1. A corrosion resistant aluminum-based alloy which is composed of a compound having a composition consisting of the general formula:

$$Al_aM_bMo_cX_dCr_3$$

wherein:

M is one or more metal elements selected from the group consisting of Ni, Fe, Co, Ti, V, Mn, Cu and Ta;

X is Zr or a combination of Zr and Hf; and a, b, c, d and e are, in atomic percentages;

$50\% \leqq a \leqq 89\%$, $1\% \leqq b$ 25%, $2\% \leqq c \leqq 15\%$, $4\% \leqq d \leqq 20\%$ and $4\% \leqq e \leqq 20\%$, said compound being at least 50% by volume composed of an amorphous phase.

2. The alloy of claim 1, wherein the ratio of Cr to Zr in said alloy is from 0.8:1 to 1.8:1.

3. The alloy of claim 1, wherein X is Zr.

4. The alloy of claim 1, wherein X is a combination of Zr and Hf.

5. The alloy of claim 1, wherein said alloy is $Al_{50}Ni_{10}Mo_9Zr_9Cr_{13}$.

6. The alloy of claim 1, wherein said alloy is $Al_{59}Ni_2Mo_9Zr_{14}Cr_9$.

7. The alloy of claim 1, wherein said alloy is $Al_{59}Ni_9Zr_5Hf_4Cr_{14}$.

8. The alloy of claim 1, wherein said alloy is $Al_{68}Ni_9Mo_7Zr_7Cr_9$.

9. The alloy of claim 1, wherein said alloy is $Al_{75}Ni_7Mo_3Zr_8Cr_7$.

10. The alloy of claim 1, wherein said alloy is $Al_{70}Fe_9Mo_5Zr_9Cr_7$.

11. The alloy of claim 1, wherein said alloy is $Al_{69.5}Ni_{6.1}Mo_{7.0}Zr_{8.7}Cr_{8.7}$.

* * * * *

UNITED STATES PATENT AND TRADEMARK OFFICE

CERTIFICATE OF CORRECTION

PATENT NO. : 5 221 375

DATED : June 22, 1993

INVENTOR(S) : Junichi Nagahora et al

It is certified that error appears in the above-identified patent and that said Letters Patent is hereby corrected as shown below:

Column 7, line 29; change the formula to read:

---$Al_aM_bMo_cX_dCr_e$---.

Column 8, lines 16 and 17; change the formula to read:

---$Al_{59}Ni_{10}Mo_9Zr_9Cr_{13}$---.

lines 18 and 19; change the formula to read:

---$Al_{59}Ni_9Mo_9Zr_{14}Cr_9$---.

lines 20 and 21; change the formula to read:

---$Al_{59}Ni_9Mo_9Zr_5Hf_4Cr_{14}$---.

Signed and Sealed this

Twenty-ninth Day of March, 1994

Bruce Lehman

*Attest:*

BRUCE LEHMAN

*Attesting Officer*

*Commissioner of Patents and Trademarks*